US006690563B2

(12) United States Patent
Ozawa et al.

(10) Patent No.: US 6,690,563 B2
(45) Date of Patent: Feb. 10, 2004

(54) ELECTROMAGNETIC ACTUATOR CONTROLLER

(75) Inventors: Hidetaka Ozawa, Saitama (JP); Kenji Abe, Saitama (JP); Yoshitomo Kouno, Saitama (JP); Minoru Nakamura, Saitama (JP); Toshihiro Yamaki, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 190 days.

(21) Appl. No.: 10/052,724

(22) Filed: Jan. 18, 2002

(65) Prior Publication Data

US 2002/0126434 A1 Sep. 12, 2002

(30) Foreign Application Priority Data

Jan. 19, 2001 (JP) ..... 2001-011699

(51) Int. Cl.[7] ..... H01H 9/00

(52) U.S. Cl. ..... 361/154; 361/139; 361/170; 123/90.11

(58) Field of Search ..... 361/152, 154, 361/139, 143, 144, 159, 170, 187; 123/499, 90.11

(56) References Cited

U.S. PATENT DOCUMENTS 5,199,392 A * 4/1993 Kreuter et al. ..... 123/90.11
6,366,441 B1 * 4/2002 Ozawa et al. ..... 361/170
6,397,798 B1 * 6/2002 Fiaccabrino ..... 123/90.11
6,549,390 B1 * 4/2003 Ozawa et al. ..... 361/139

FOREIGN PATENT DOCUMENTS

JP 10-274016 10/1998

* cited by examiner

*Primary Examiner*—Anthony Dinkins
(74) *Attorney, Agent, or Firm*—Lahive & Cockfield, LLP

(57) ABSTRACT

A controller for an electromagnetic actuator comprises a pair of spring acting in opposite directions, and an armature coupled to a mechanical element. The armature is connected to the springs and held in a neutral position given by the springs when the actuator is not activated. The actuator includes a pair of electromagnets for driving the armature between two end positions. The controller includes voltage application means for applying voltage to an electromagnet providing one end position for a first predetermined period so as to attract the armature to the end position. The controller also includes a peak current detector for detecting the peak of current flowing through the electromagnet in the first predetermined period. In accordance with the peak value, a decision means decides the application period of voltage that is to be applied to the electromagnet after the first application period has elapsed. Thus, the armature can make a stable seating at a controlled speed without generating substantial noise.

15 Claims, 17 Drawing Sheets

(a)

(b)

(a)

(b)

ELECTROMAGNETIC ACTUATOR CONTROLLER

BACKGROUND OF THE INVENTION

The invention relates to a controller for controlling an actuator for a magnetic valve, and more specifically to a controller for an electromagnetic actuator for driving a valve of an engine mounted on such apparatus as an automobile and a boat.

Valve driving mechanism having an electromagnetic actuator has been known and called a magnetic valve. An electromagnetic actuator typically includes a moving iron or an armature, which is placed between a pair of springs with given off-set load so that the armature positions at an intermediate part of a pair of electromagnets. A valve is connected to the armature. When electric power is supplied to the pair of electromagnets alternately, the armature is driven reciprocally in two opposite directions thereby driving the valve. Conventionally, the driving manner is as follows.

1) The magnetic attraction power that one of the electromagnets provides to the armature overcomes rebound power by the pair of springs and attracts the armature to make it seat on a seating position. The armature (valve) is released from the seating position by such a trigger as suspension of power supply to the electromagnet, and starts to displace in a cosine function manner by the force of the pair of springs.

2) At a timing according to the displacement of the armature, an appropriate current is supplied to the other electromagnet to produce magnetic flux that generates attraction force.

3) The magnetic flux rapidly grows as the armature approaches the other electromagnet that is producing the magnetic flux. The work by the attraction power generated by the other electromagnet overcomes the sum of (i) a small work by the residual magnetic flux produced by the one electromagnet which acts on the armature to pull it back and (ii) a mechanical loss which accounts for a large portion of the sum of work. Thus, the armature is attracted and seats on the other electromagnet.

4) At an appropriate timing as the armature seats, a constant current is supplied to the other electromagnet to hold the armature in the seated state.

Thus, as an armature nears a seated state side, magnetic attraction power becomes big rapidly. In addition, excessive electric power may be supplied in order to realize stable seating. Seating speed may become larger than 1 m/s, for example, generating undesired sound when seating is done. Various techniques have been proposed for lowering the seating speed.

For example, Japanese Patent Application Unexamined Publication (Kokai) No. 10-274016 describes a scheme wherein when making an armature (movable element) seat, power is supplied to an electromagnet for a first predetermined period, followed by suspension of power supply for a second predetermined period, and then power supply to the electromagnet is resumed. When power supply is suspended, attraction power to attract the armature lowers rapidly. However, the armature continues to move by inertia. When power supply is resumed, the attraction power increases again. The first predetermined period and the second predetermined period are determined according to the position of the armature. Thus, seating speed of the armature is finely adjusted to reach a seated state.

Conventionally, to supply electric power to perform over-excitation for an electromagnet of the electromagnetic actuator, there are such schemes as to supply constant current and to apply constant voltage. In such power supply schemes, magnetic attraction power increases sharply resulting in collision of the armature to a seating surface.

As a specific example, assume that electromagnetic actuators are used to drive a valve train of an engine at high speed, that constant voltage is applied during over-excitation period, and that optimization is performed to lower the seating speed of the armatures. Referring to FIG. 18, the left vertical scale shows displacement (mm) and speed (m/s) of an armature as well as current (A) supplied to the electromagnet. The right vertical axis shows attraction power (N), and voltage applied to the electromagnet (V).

At time t1 (time zero), power supply to the electromagnet is suspended, and the armature that has been seated in a closed valve state is released. In response to this, displacement of an armature begins to increase. Here, the displacement has been −0.2 mm, which is a clearance between a closed position of the valve shaft and the armature when the valve is closed. The clearance enables the valve to completely close an exhaust/intake opening. At about time t2 (0.8 ms), armature speed sharply drops. This means that the clearance reaches 0 mm as the armature is released and collide and Join with the static valve shaft. The armature is now capable of driving the valve shaft.

At about time 3.2 ms, over-excitation voltage is applied to the electromagnet. As the armature approaches an open valve position, magnetic attraction power rapidly increases. Immediately after the armature is seated in an open valve position, the attraction power exceeds a minimum holding force (400N), which is minimum force for maintaining a seated state. Thus, the armature is held in the seated state. Over-excitation finishes around time t3 (4.2 ms). Then, a constant current control for holding the armature in the seated position starts. As shown in the drawing, seating speed at time t3 is about 0.5 m/s, which is not small enough. However the starting and finishing time of over-excitation is adjusted, it is difficult to control the seating speed to a substantially small value.

The scheme described in the above mentioned Kokai No. 10-274016 is not capable of prevention collision of the armature to a seating. Thus, there is a need for a controller for an actuator which provides a low seating speed of the armature, thereby preventing the armature from generating large noise when it reaches and seats on a seating surface.

SUMMARY OF THE INVENTION

According to one aspect of the invention, a controller for an electromagnetic actuator comprises a pair of spring acting in opposite directions, and an armature coupled to a mechanical element. The armature is connected to the springs and held in a neutral position given by the springs when the actuator is not activated. The actuator includes a pair of electromagnets for driving the armature between two end positions. The controller includes voltage application means for applying voltage to an electromagnet corresponding to one end position for a first predetermined period so as to attract the armature to the end position. The controller also includes a peak current detector for detecting the peak of current flowing through the electromagnet in the first predetermined period. In accordance with the peak value, a decision means decides the application period of voltage that is to be applied to the electromagnet after the first application period has elapsed.

According to one aspect of the invention, because the voltage application period is determined according to the peak current, the armature can seat with a controlled seating speed without generating substantial noise.

According to one embodiment of the invention, the decision means for deciding the voltage application period decides the voltage to be applied to the electromagnet after the first application period in accordance with the peak current detected by the peak current detector. In this manner, the armature can seat with a seating speed which does not do generate undesired noise.

According to another aspect of the invention, the decision means for deciding the voltage application period decides a second application period for a second voltage and a third application period for a third voltage in accordance with the peak current detected by the peak current detector. The voltage application means applies the second voltage to the electromagnet over the second determined application period after the first application period has elapsed. Then, the voltage application means applies the third voltage to the electromagnet over the third application period. The second voltage is lower than the first voltage, and the third voltage is set higher than the second voltage. In this manner, attraction power is controlled such that the armature seats with a lower seating speed.

According to another aspect of the invention, the controller further comprises magnetic flux estimation means for estimating magnetic flux that the electromagnet attracting the armature generates when driving the armature from one end position to the other end position. The controller further comprises means for controlling power supply to the electromagnet such that magnetic flux estimated by the magnetic flux estimation means converges into the magnetic flux that is required for holding the armature in the other end position after voltage application to the electromagnet for the period decided by the voltage application period decision means finishes.

In this manner, magnetic flux generated from the electromagnet is controlled to converge into the magnetic flux that is necessary for holding the armature. Thus, a stable attraction force is produced enabling stable seated state of the armature.

According to yet another embodiment of the invention, the controller further comprises magnetic flux estimation means for estimating magnetic flux that the electromagnet attracting the armature generates when driving the armature from one end position to the other end position. The controller further includes means for controlling power supply to the electromagnet after the first application period elapsed, such that magnetic flux estimated by the magnetic flux estimation means converges into magnetic flux that is predetermined based on the peak current detected by the peak current detector.

In this manner, because magnetic flux generated from the electromagnet is controlled to converge into magnetic flux that is predetermined based on the peak current, a stable attraction power at the time of seating and after seating is produced, enabling seating without generating substantial noise and enabling maintenance of stable seating state.

DESCRIPTION OF THE PREFERRED EMBODIMENTS

Figure 1:
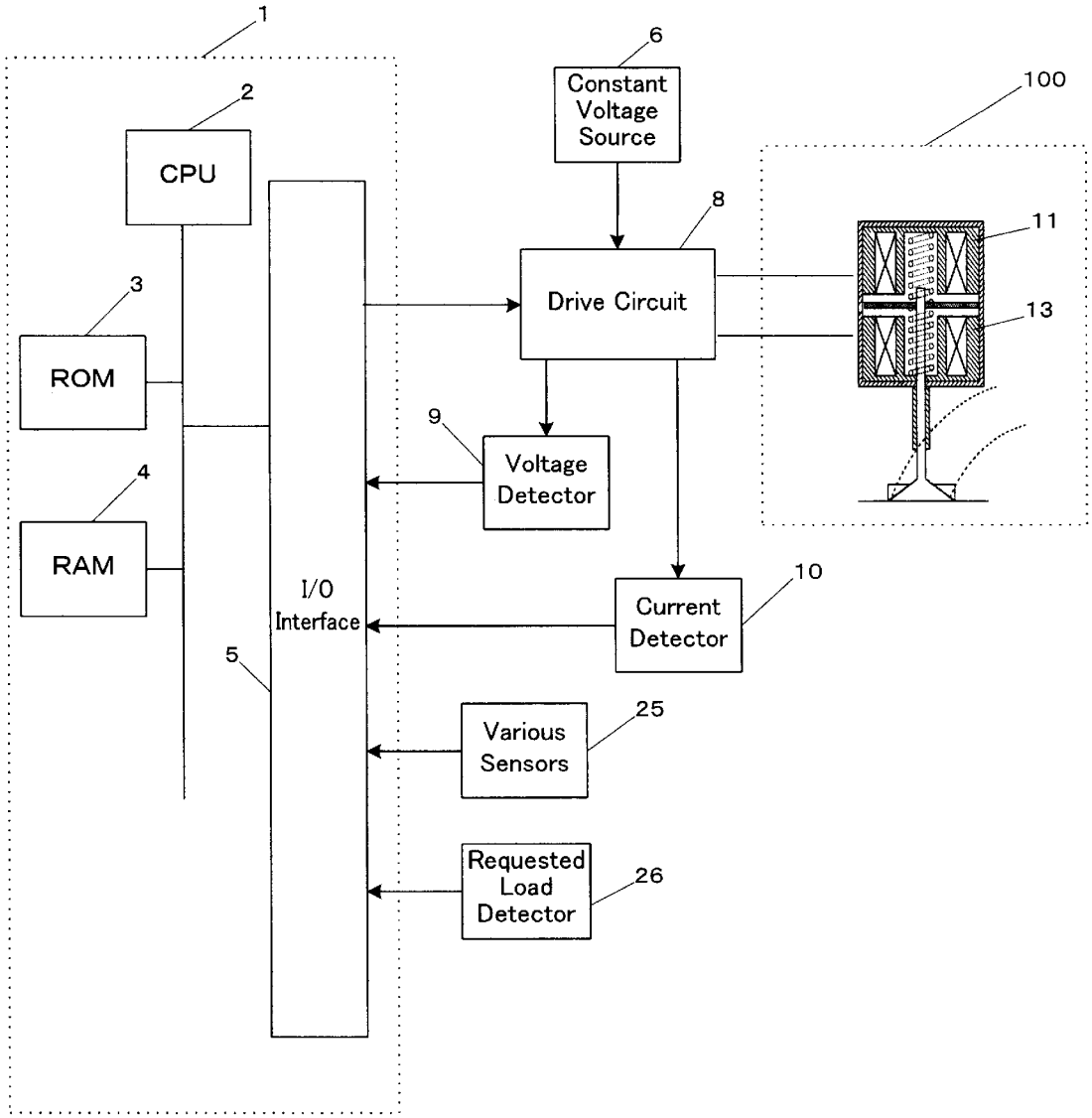
FIG. 1 is a general block diagram of the electromagnetic actuator controller according to one embodiment of the invention.

Referring now to the drawings, specific embodiments of the invention will be described. FIG. 1 is a block diagram showing a general structure of an electromagnetic actuator controller. A controller 1 comprises a central processing unit (CPU) 2 including a microcomputer and its related circuits. The controller includes a read only memory (ROM) 3 for storing computer programs and data, a random access memory (RAM) 4 providing a working area for the CPU 2 and storing results of operations by the CPU 2, and an input-output (I/O) interface 5.

The input-output interface 5 receives signals from various sensors 25, which among others includes engine speed (Ne), engine water temperature (Tw), intake air temperature (Ta), battery voltage (VB), and ignition switch (IGSW). The I/O interface 5 also receives a signal indicating desired torque detected by a requested load detector 26. The detector 26 can be an accelerator pedal sensor that detects the magnitude of depression of the accelerator pedal.

A drive circuit 8 supplies electric power from a constant voltage source 6 to a first electromagnet 11 and a second electromagnet 13 of an electromagnetic actuator 100 based on a control signal from the controller 1. In one embodiment of the invention, electric power for attracting an armature is supplied as a constant voltage, and electric power for holding the armature in a seating position is supplied as a constant current. A constant current control can be carried out, for example, by pulse duration modulation of the voltage supplied from the constant voltage source 6, or by repeating on and off of the voltage based on comparison by a comparator of flowing current with a target current.

A voltage detector 9 connected to the drive circuit 8 detects the magnitude of voltage supplied to the first and the second electromagnets 11 and 13 and sends the results to the controller 1. A current detector 10 connected to the drive circuit 8 detects the magnitude of current supplied to the first and the second electromagnets 11 and 13 and sends the results to the controller 1.

Based on inputs from various sensors 25, input from the requested load detector 26, and signal input from the voltage detector 9 as well as the current detector 10, the controller 1 determines such parameters as timing of power supply, magnitude of voltage to be supplied, and voltage application period in accordance with the control program stored in the ROM 3. Then, the controller 1 sends control signals for controlling the electromagnetic actuator 100 to the drive circuit 8 over the input-output interface 5. Thus, the drive circuit 8 provides optimized current to the first and the second electromagnets 11 and 13. The current is optimized for fuel consumption, emission reduction, and output characteristics enhancement of an internal combustion engine.

Figure 2:
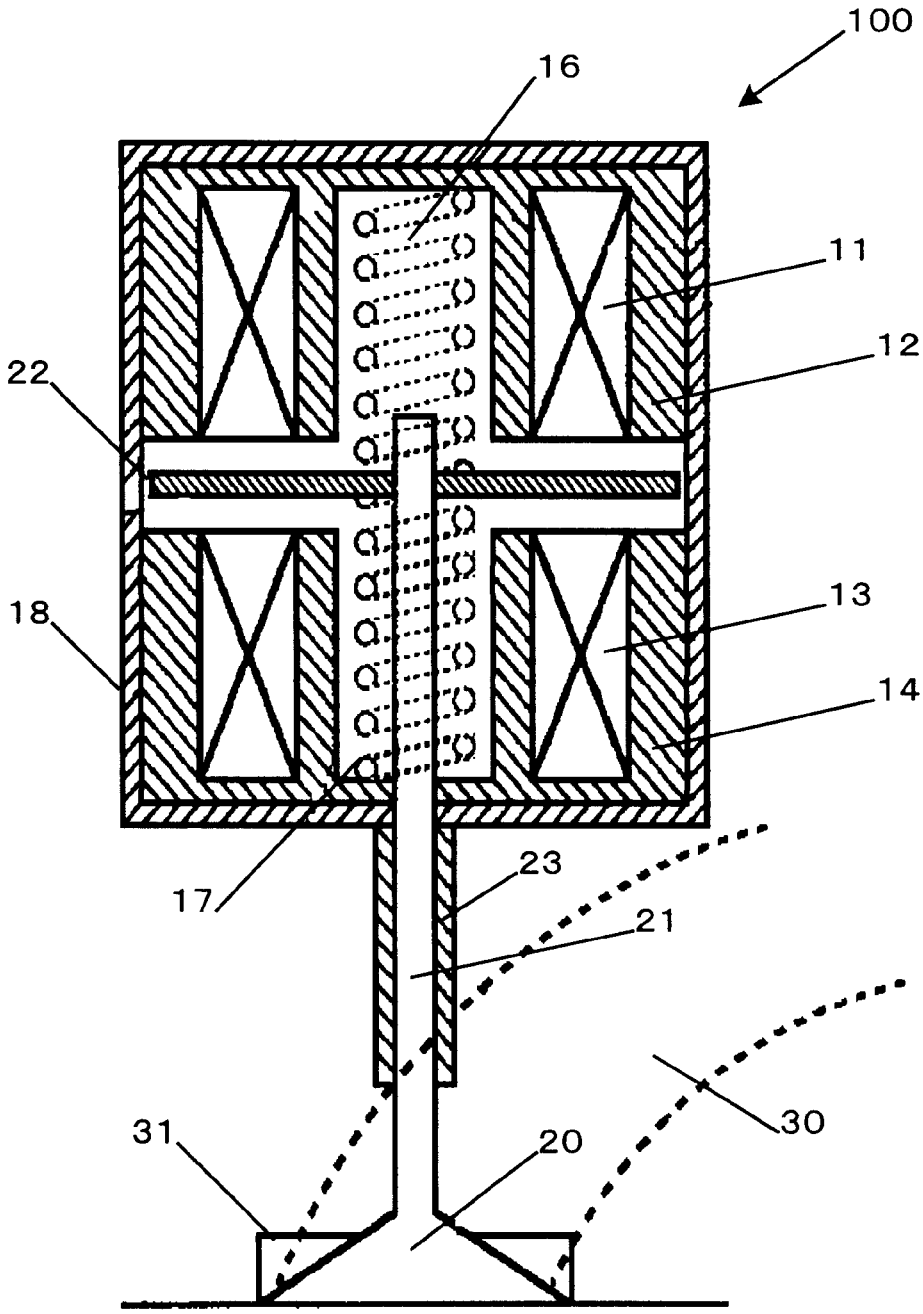
FIG. 2 shows a mechanical construction of the electromagnetic actuator of one embodiment of the invention.

FIG. 2 is a sectional drawing showing the structure of the electromagnetic actuator 100. A valve 20 is provided at an intake port or an exhaust port (referred to as intake/exhaust port) so as to open and close the intake/exhaust port 30. The valve 20 seats on a valve seat 31 and closes the intake/exhaust port 30 when it is driven upwardly by the electromagnetic actuator 100. The valve 20 leaves the valve seat 31 and moves down a predetermined distance from the valve seat to open the intake/exhaust port 30 when it is driven downward by the electromagnetic actuator 100.

The valve 20 extends to a valve shaft 21. The valve shaft 21 is accommodated in a valve guide 23 so that it can move in the direction of the axis. A disc-shaped armature 22 made of a soft magnetic material is mounted at the upper end of the valve shaft 21. The armature 22 is biased with a first spring 16 and a second spring 17 from top and bottom.

A housing 18 of electromagnetic actuator 100 is made of nonmagnetic material. Provided in the housing 18 are a first electromagnet 11 of solenoid type placed above the armature 22, a second electromagnet 13 of solenoid type located underneath the armature 22. The first electromagnet 11 is surrounded by a first electromagnet yoke 12, and the second electromagnet 13 is surrounded by a second electromagnet yoke 14. The first spring 16 and the second spring 17 are balanced to support the armature 22 in the middle between the first electromagnet 11 and the second electromagnet 13 when no exciting current is supplied to the first electromagnet 11 or the second electromagnet 13.

When exciting current is supplied to the first electromagnet 11 by the drive circuit 8, the first electromagnet yoke 12 and the armature 22 are magnetized to attract each other, thereby pulling up the armature 22. As a result, the valve 20 is driven upwardly by the valve shaft 21, and seats on the valve seat 31 to form a closed state.

Cutting off the current to the first electromagnet 11 and starting current supply to the second electromagnet 13 will make the second electromagnet yoke 14 and the armature 22 magnetized to produce a force which combined with the potential energy of the springs attracts the armature 22 downwardly. The armature 22 contacts the second electromagnet yoke 14 and stops there. As a result, the valve 20 is driven downwardly by the valve shaft 21 to form an open state.

Figure 3:
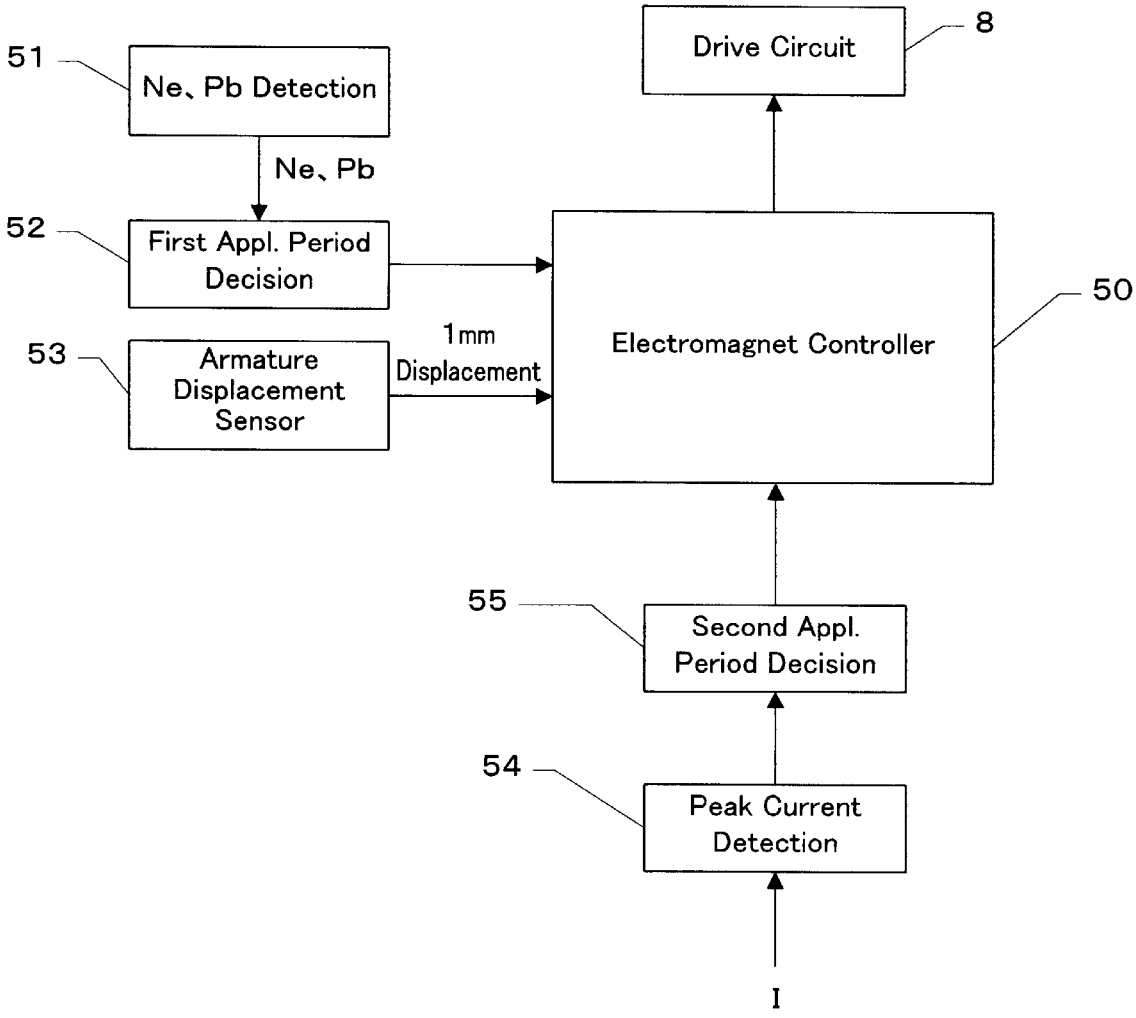
FIG. 3 is a functional block diagram of the electromagnetic actuator controller of one embodiment of the invention.

FIG. 3 is a detailed functional block diagram of the electromagnetic actuator controller 1 of FIG. 1. In one embodiment of the invention, over-excitation of the coil or windings of the electromagnet is performed in three periods, the first period through the third period.

An electromagnet controller 50 controls the drive circuit 8 so that constant voltage is applied to the windings of the electromagnet during over-excitation for attracting the armature. It also controls the drive circuit 8 so that constant current is supplied to the windings of the electromagnet during holding operation for holding the armature.

A Ne, Pb detector 51 detects engine speed Ne based on outputs from an engine speed sensor, and detects intake pipe pressure Pb based on outputs from an intake pipe pressure sensor. Pb is a parameter indicating load condition of the engine, and Ne is a parameter indicative of operating speed of a valve of the engine, which corresponds to operating speed of the armature. An armature displacement sensor 53 detects a displacement of the armature.

A first application period determination unit 52 determines starting and closing time of the first over-excitation based on Ne and Pb. Specifically, the unit 52 refers to a first over-excitation timing map that is stored in ROM 3 and indicates correspondence among Ne, Pb, voltage application starting time, and application period. By referring to the map, the unit 52 extracts a first application starting time and application period. The first application starting time is expressed in terms of the time from the point in time of 1 mm displacement of the armature (the point where the armature moved 1 mm after it is released). The first over-excitation timing map is made so that the longer the application period becomes as the larger the load is.

In another embodiment, the over-excitation timing map indicates correspondence among Ne, Pb, and applied voltage. The map is made so that as the load becomes larger, the applied voltage becomes larger. In further another embodiment, the over-excitation timing map includes both applied voltage and application period in addition to Ne and Pb. In addition, the over-excitation timing map may be made to include other parameters such as accelerator opening, throttle opening, and temperature of the windings in addition to or in place of intake pipe pressure Pb and engine speed Ne.

The electromagnet controller 50, responsive to 1 mm displacement of the armature detected by displacement sensor 53, starts applying a first preset voltage to the windings at the first application starting time given by the first application period determination unit 52. This voltage application continues till the first application period elapses.

A peak current detector 54 monitors current flowing in the windings during the first application period determined by the determination unit 52 to detect peak current value in the first application period. A second application period determination unit 55 determines an application period of voltage for over-excitation after the first application period in accordance with the current peak value detected by the peak current detector 54.

Specifically, the second determination unit 55 refers to "a second over-excitation timing map" that indicates correspondence between the peak current and second application periods to extract a second application period based on the detected current peak. A second application period determination unit 55 refers to "a third over-excitation timing map" that indicates correspondence between the peak current and third application periods to extract a third application period based on the detected current peak.

After the first application period elapses, the electromagnet controller 50 applies a preset second voltage to the windings during the second application period given by the second determination unit 55. After the second application period elapses, the controller applies a preset third voltage to the windings during the third application period given by the second determination unit 55. The second voltage is set lower than the first voltage and the third voltage.

In another embodiment, the second and the third over-excitation timing maps are maps indicating correspondence among the peak current, applied voltage and application periods of the voltage. In this case, the second and the third voltages are not preset to constants. The second determination unit 55 refers to the second and the third over-excitation timing maps to extract voltage and application period based on the peak current value. The electromagnet controller 50 applies the second voltage given by the second determination unit 55 to the windings during the second application period given by the second determination unit 55. After the second application period elapses, the electromagnet controller 50 applies the third voltage given by the second application period determination unit 55 to the windings during the third application periods given by the second determination unit 55.

In another embodiment, the second and the third over-excitation timing maps are maps indicating correspondence between the peak current and application voltage. In this case, the second and the third application periods are preset. The second determination unit 55 refers to the second and the third over-excitation timing maps to extract second and third voltages based on the peak current value. The electromagnet controller 50 applies the second voltage given by the second determination unit 55 to the windings during the predetermined second application period. Then, the controller 50 applies the third voltage given by the second determination unit 55 to the windings during the predetermined third application period.

Figure 4:
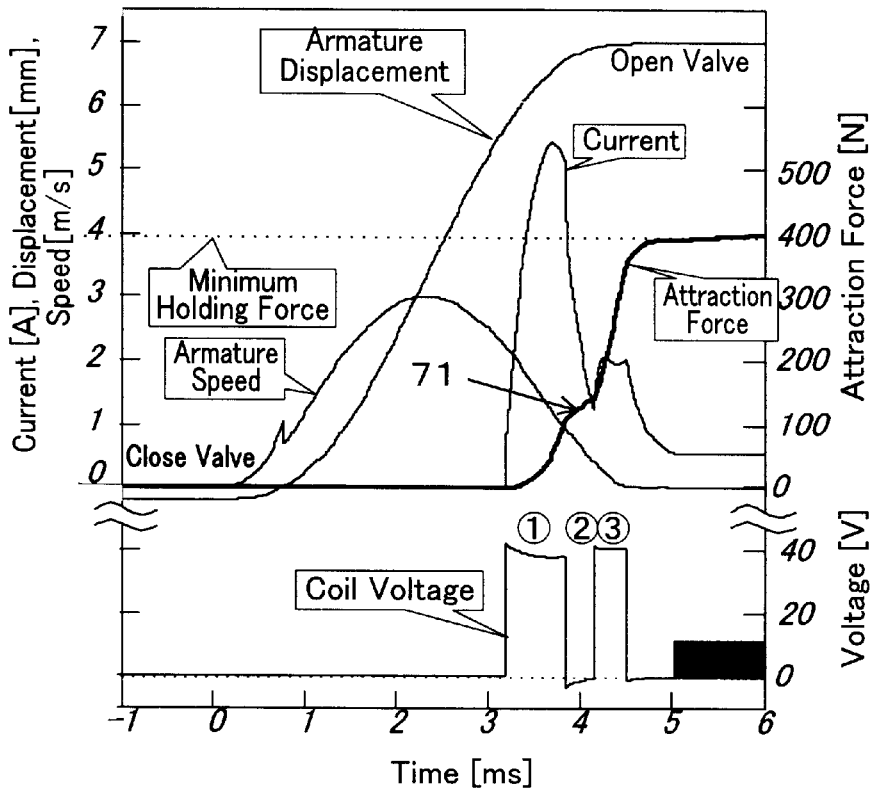
FIG. 4 shows the relationship of various parameters when operation is divided into three periods, and over-excitation is performed according to one embodiment of the invention.

Referring now to FIG. 4, three period over-excitation scheme in accordance with one embodiment of the invention will be described The first over-excitation (shown by ①) starts around 3.2 ms in time. In the first over-excitation, a first voltage 42V is applied to the windings through a switching element for the first application period. Magnetic energy is stored in the electromagnetic actuator as voltage is applied to the windings. A portion of such magnetic energy is converted into mechanical work for attracting the armature. Air gap between the armature and the seating surface of the yoke of the electromagnet when the first application period finishes is 0.277 mm, and attraction force is 106 N.

After the first application period elapses, the second over-excitation (shown by ② is activated. In the second over-excitation, a second voltage lower than the first voltage is applied to the windings for the second application period through a switching element. In this example, the second voltage is 0V, and a fly-wheel diode is used. As a low second voltage is applied, energy accompanying the voltage drop produced over the switching elements of the drive circuit is supplied from the electromagnetic actuator to the drive circuit, generating loss with the drive circuit. On the other hand, the armature continues to move during this period by means of inertia, thereby reducing the air gap. Due to it, magnetic resistance reduces and magnetic flux in the magnetic path increases, suppressing increase of the attraction force as shown by reference number 71. The air gap at the end of the second application period is 0.066 mm, and the attraction force is 143 N.

After the second application period passed, the third over-excitation (shown by ①) is activated. In the third over-excitation, the third voltage 42V larger than the second voltage is applied to the windings through a switching element for the third application period. In this embodiment, the same voltage is used for the third and the first application voltages. However, they may be different voltages. As shown in the drawing, the attracting force is small at the beginning of the third application period and armature speed is small at the end of the third application period. Accordingly, "attraction force×armature speed" or the mechanical work by the attracting force does not increase.

In this way, by attracting the armature in the first application period and applying a low voltage in the second application period, increase of the attraction power is suppressed, reducing the armature speed. Therefore, in the third application period, the attraction power does not excessively exceed the minimum attraction force required to hold the armature. Thus, the armature is stably seated.

In this embodiment, over-excitation is carried out in three separate periods. In another embodiment, it can be carried out in more than three separate periods. The second application period and/or the second voltage may be adjusted according to the peak current in the first application period, and the armature may be controlled to seat in the second application period.

According to this embodiment, 42 V is applied to the windings in the first application period, 0 V in the second application period, and 42 V in the third application period 42V. These voltage values vary depending on the voltage of the power source and different values can be chosen. Thus, the voltages are not limited to these values.

Figure 5:
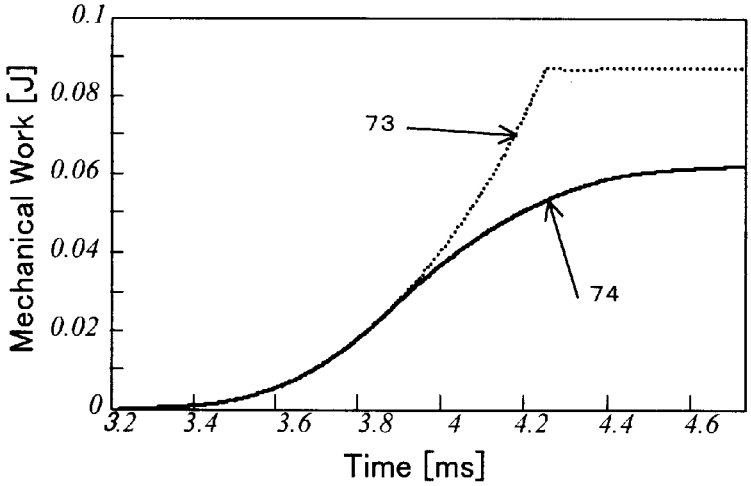
FIG. 5 shows mechanical work by armature attraction in accordance with one embodiment of the invention in contrast to the one according to conventional scheme.
Figure 18:
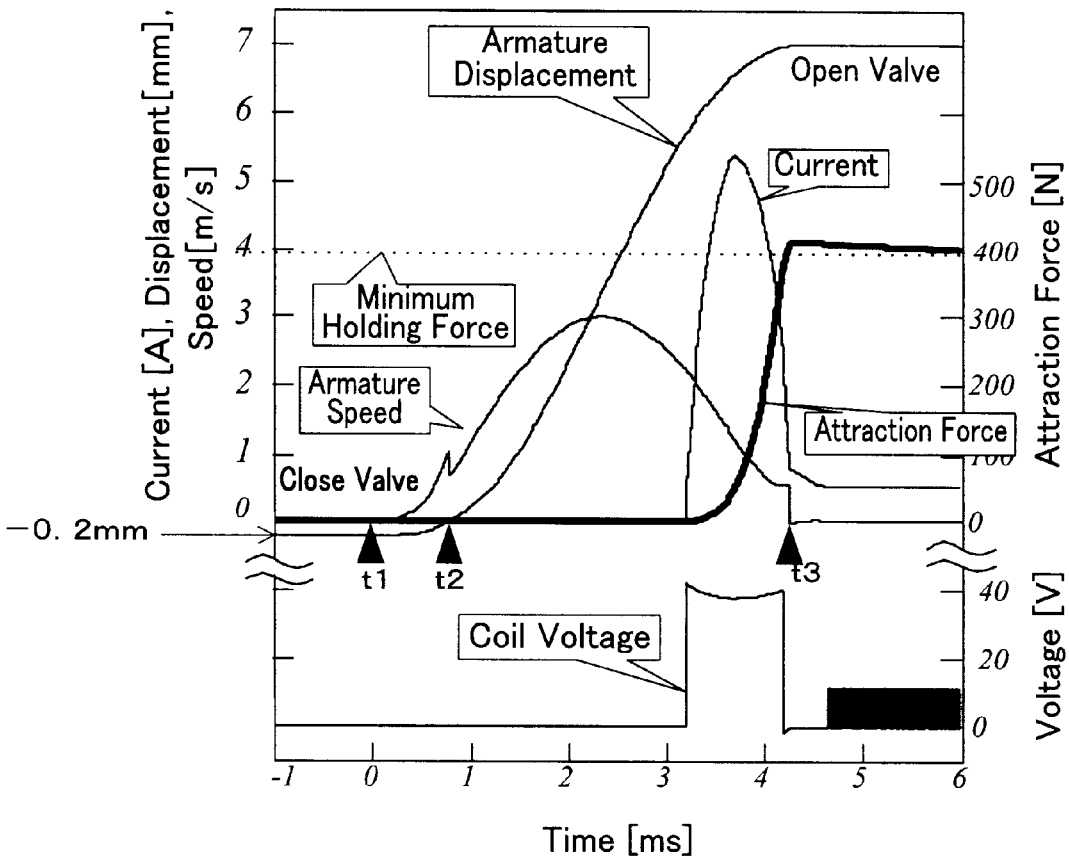
FIG. 18 shows the relationship among various parameters of conventional electromagnetic actuator control.

FIG. 5 shows transition of mechanical work of seating operation in accordance with an embodiment of the present invention. A similar transition according to a conventional scheme is also shown for comparison. Curve 73 shows mechanical work according to a conventional scheme, while curve 74 shows mechanical work in accordance with one embodiment of the invention. As described referring to FIG. 18, the attraction power rapidly increases in the seating area according to the prior art. Thus, kinetic energy of the armature increases, resulting in a high seating speed. In contrast, according to the present invention, after the armature is attracted in the first application period, a low voltage is applied to the windings in the second application period, making a gentle increase of mechanical work immediately before seating. Thus, increase of the armature is suppressed, enabling seating without generating much noise.

In order to make full use of the performance of the above-described scheme, it is desirable to ensure a stable operation even when dispersion is caused in armature displacement for some reasons. Dispersion of armature displacement takes place in phase and amplitude. Phase dispersion is shifting in time of the graph of armature displacement. Amplitude dispersion is variation in the distance from the peak of free vibration when the armature is in free vibration to the seating surface (un-traveled distance). The phase dispersion is caused by variation of armature release time due to dispersion of the attraction force of the actuator. The amplitude dispersion is caused by dispersion of friction of the valve shaft.

These dispersion needs to be detected so as to cope with. With regard to the phase dispersion, the time when the armature displaces from the seating surface by 1 mm is detected so as to determine the magnitude of phase shift. Amplitude dispersion can be determined based on the peak current when over-excitation voltage is applied to the windings.

Figure 6:
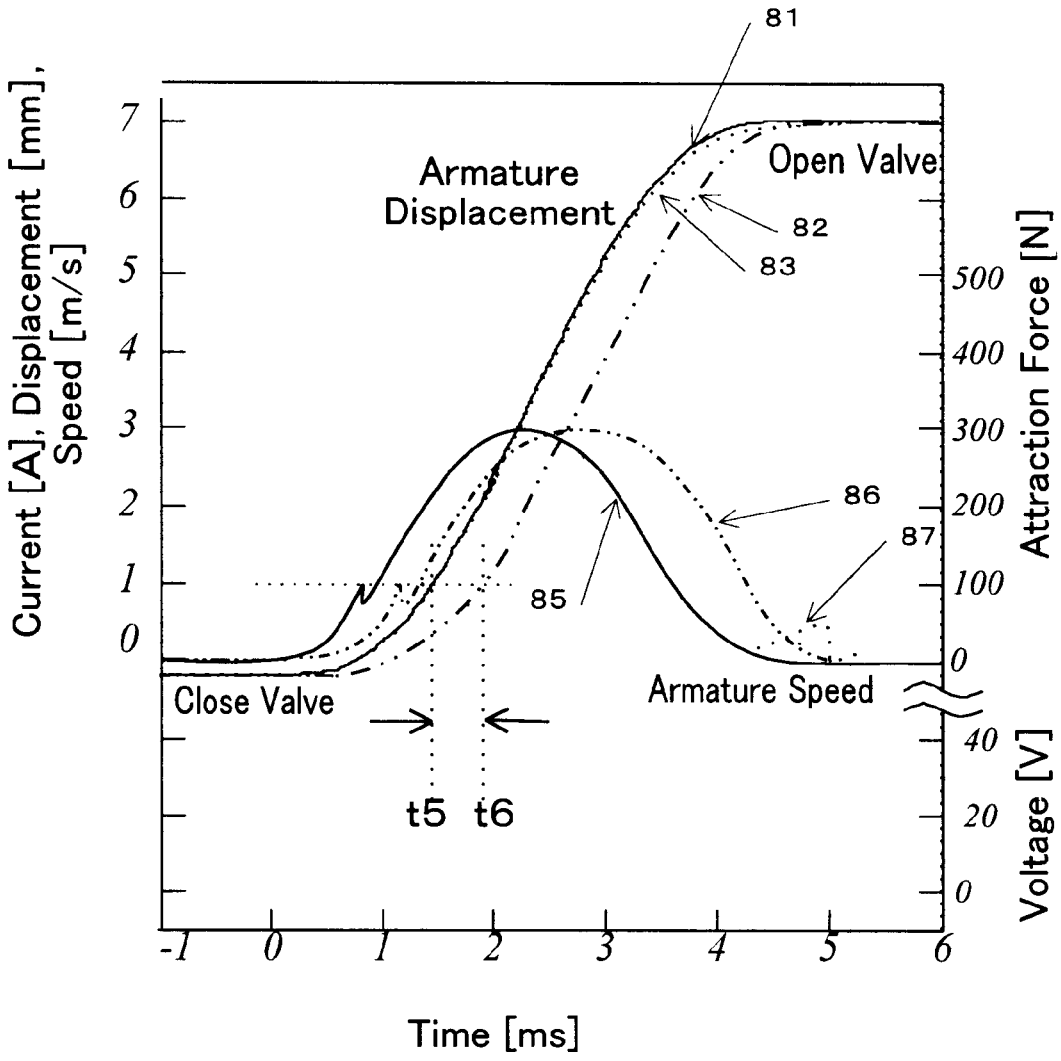
FIG. 6 shows the relationship of various parameters when phase shift is produced and when amplitude shift is produced, in normal operation of the armature in of one embodiment of the invention.

Referring now to FIG. 6, a manner for detecting phase dispersion will be described. Curve 81 in solid line indicates a standard armature displacement waveform when phase shift or amplitude shift does not exist. Curve 82 in broken line indicates an armature displacement waveform when phase shifted as against the waveform 81 due to increase of the attraction force by the opposite electromagnet. The difference between 1 mm lift (displacement) detecting point t5 of the curve 81 and t6 of the curve 82 represents the phase shift, which in this case is 0.45 ms. In this manner, by detecting time difference of 1 mm displacement points, phase shift against the standard waveform 81 can be detected.

Curve 83 in dotted line is a waveform where friction has grown three times larger, causing larger un-traveled distance to the seating surface. As is apparent from drawing, the curves 81 and 83 are almost the same, showing no amplitude dispersion.

Curve 85 in solid line indicates armature speed corresponding to the standard displacement waveform 81. Curve 86 in broken line indicates armature speed corresponding to the displacement waveform 82 with phase shift. Curve 87 in dotted line indicates armature speed corresponding to the displacement waveform 83 with amplitude shift. As is apparent from drawing, phase shift can also be detected from the waveforms of armature speed. As can be seen from FIG. 6, the curves 85 and 87 almost overlap. Thus, amplitude shift cannot be detected from armature speed.

Figure 7:
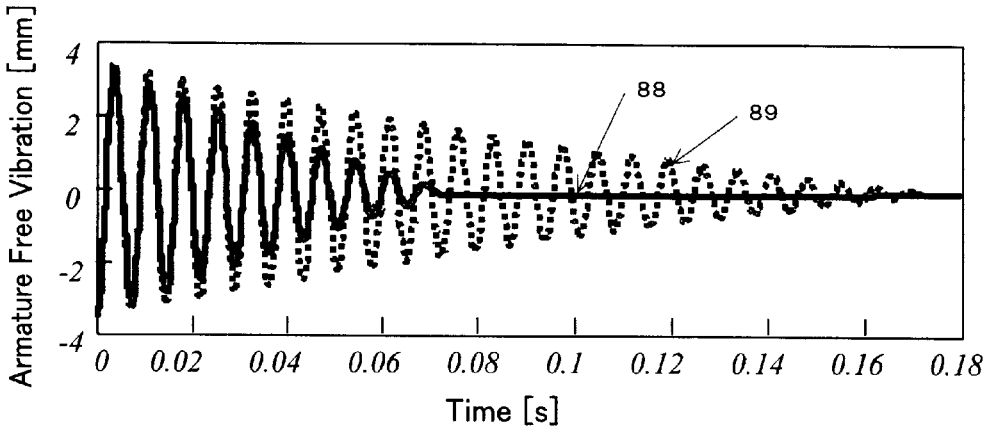
FIG. 7(*a*) shows time waveform of free vibration of the armature and (*b*) shows the relationship between uncompleted travel distance of the armature and the peak current in the first application period according to one embodiment of the invention.
Figure 7:
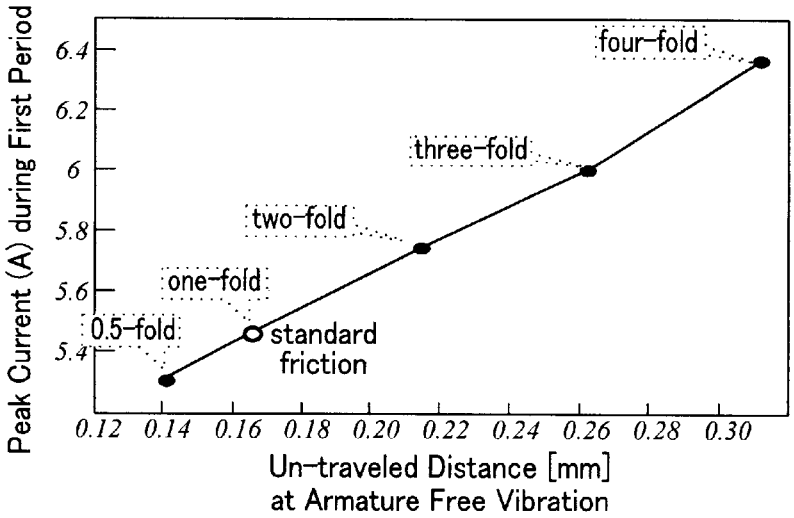

FIG. 7(*a*) indicates the relationship between the free vibration of the armature and friction. Curve 89 in dotted line represents time waveform of free vibration of the normal under a standard friction (unit). Curb 88 in solid line represents time waveform of free vibration when friction is three times of the standard friction. As can be seen from the drawing, free vibration converges quickly under a large friction. Therefore, large friction will lead to a large un-traveled distance to the seating surface of the armature.

Referring now to FIG. 7(*b*), detection of amplitude dispersion will be described. As described above, as friction increases un-traveled distance becomes larger. Peak current through the coil increase in proportion. This is because as the un-traveled distance becomes larger the air gap between the armature and the yoke of the electromagnet becomes larger, incurring a larger current through the windings, which acts to suppress variation of total magnetic flux flowing through magnetic path. In other words, current increases to compensate for the back electromotive force of the windings. Therefore, amplitude dispersion can be detected by detecting peak current in the first application period.

The three period over-excitation is controlled based on detected dispersion of phase and amplitude. Specifically, 1) When there is no dispersion in phase and amplitude:
   1 mm displacement time of the armature is detected, and responsive to such detection, the first application starting time and the first application period are determined referring to "first over-excitation timing map".
2) When there is phase variation:
   1 mm displacement time of the armature is detected, and shift the first application starting time by the difference of this time from the standard 1 mm displacement time. Similar to 1), the first application starting time and the first application period are determined referring to "first over-excitation timing map".
3) When there is amplitude variation:
   Peak current in the first application period is detected, and the second application period is determined referring to "second over-excitation timing map" in accordance with the peak current. Also, the third application period is determined referring to "third over-excitation timing map" in accordance with the peak current.

Figure 8:
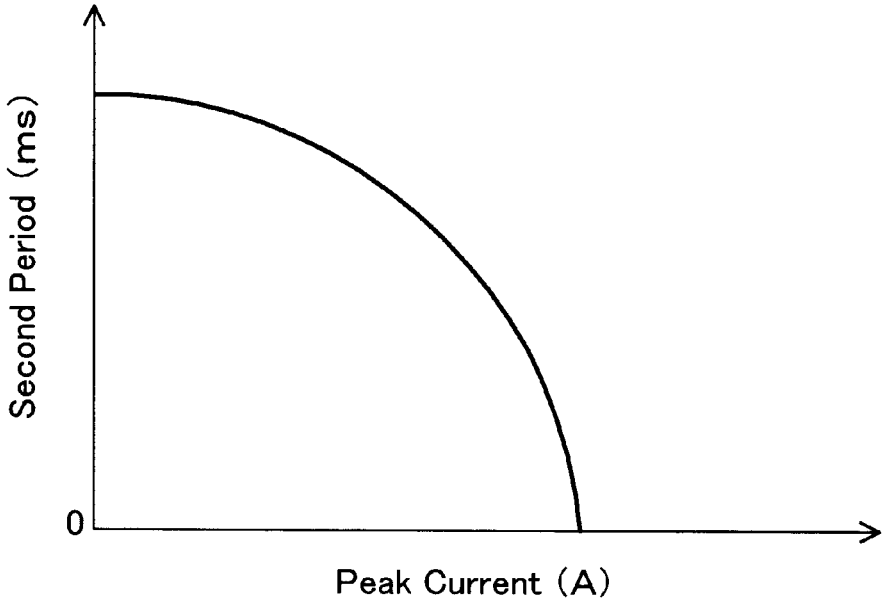
FIG. 8(*a*) shows a second over-excitation timing map indicating the relationship between the peak current value and the second application period and (*b*) shows a third over-excitation timing map indicating the relationship between the peak current value and the third application period, in one embodiment of the invention.
Figure 8:
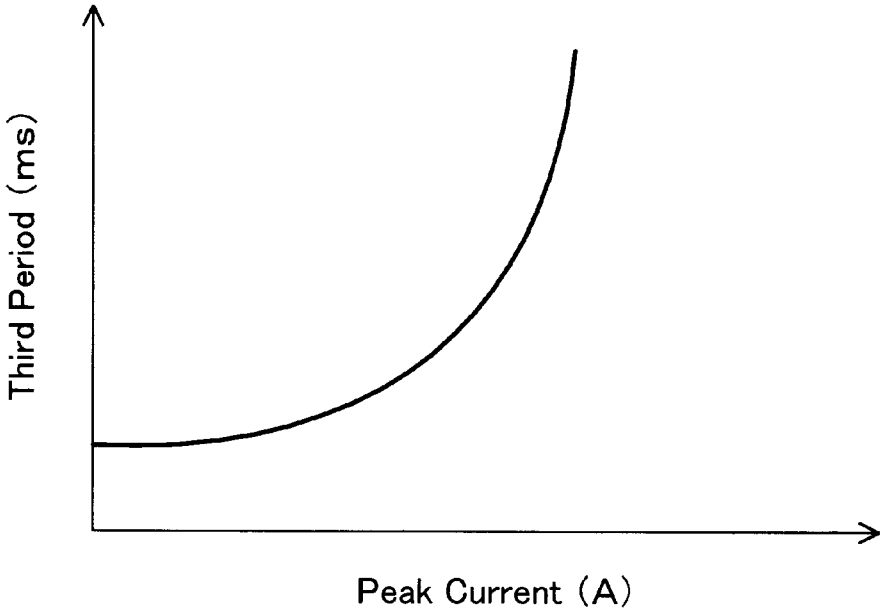

An example of the second over-excitation timing map is illustrated in FIG. 8(*a*). An example of the third over-excitation timing map is illustrated in FIG. 8(*b*). Large friction and large un-traveled distance means that the distance to the seating surface is large. In the second application period, a second voltage that is lower than the voltage applied in the first application period is applied to the windings. In the third application period, a third voltage that is higher than the second voltage is applied. The second over-excitation timing map is prepared such that as the peak current becomes larger (in other words, as the un-traveled distance becomes larger), the second application period becomes shorter. The third over-excitation timing map is prepared such that as peak current becomes larger, the third application period becomes longer. These maps are prepared beforehand and are stored in the ROM.

A second embodiment of the invention will now be described. According to this embodiment, when over-excitation of the windings finishes and holding operation of the armature is performed, the attraction force is controlled to converge to a target value and a stable seating of the armature is realized. It is difficult to measure the attraction force when the armature is operating. Thus, magnitude of the attraction force is estimated by estimating total magnetic flux from direct current resistance of the windings of the electromagnetic actuator.

When the yoke of the electromagnet is made in layer structure like the one in an electric power transformer, effects of eddy current loss in magnetic materials can be made extremely small. Thus, the actuator can be assumed to a pure inductance element when viewed as a load. The electromagnetic circuitry can be expressed as follows.

$$E \approx RI + \frac{d\Phi_{all}}{dt} \tag{1}$$

Terminal voltage E of the electromagnetic actuator is nearly the sum of product of the direct current resistance R of the windings and driving current I, and change in time of total magnetic flux $\Phi_{all}$. Because there is eddy current loss in reality, R is larger than the DC resistance of the windings, and is a function of time. Enough accuracy can be achieved for practical use by setting R to a value slightly larger than DC resistance to make up for the difference. Now, the total magnetic flux $\Phi_{all}$ can be expressed as follows.

$$\Phi_{all} = \int (E - RI)dt \quad (2)$$

Referring to FIG. 1, voltage E and current I are detected by the voltage detector 9 and the current detector 10 respectively. Total magnetic flux $\Phi_{all}$ at any given time can be calculated by the integrator that has a function of resetting integral values. $\Phi_{all}$ in expression (2) is an estimate value of total magnetic flux, which is referred to as "estimated total magnetic flux".

Figure 9:
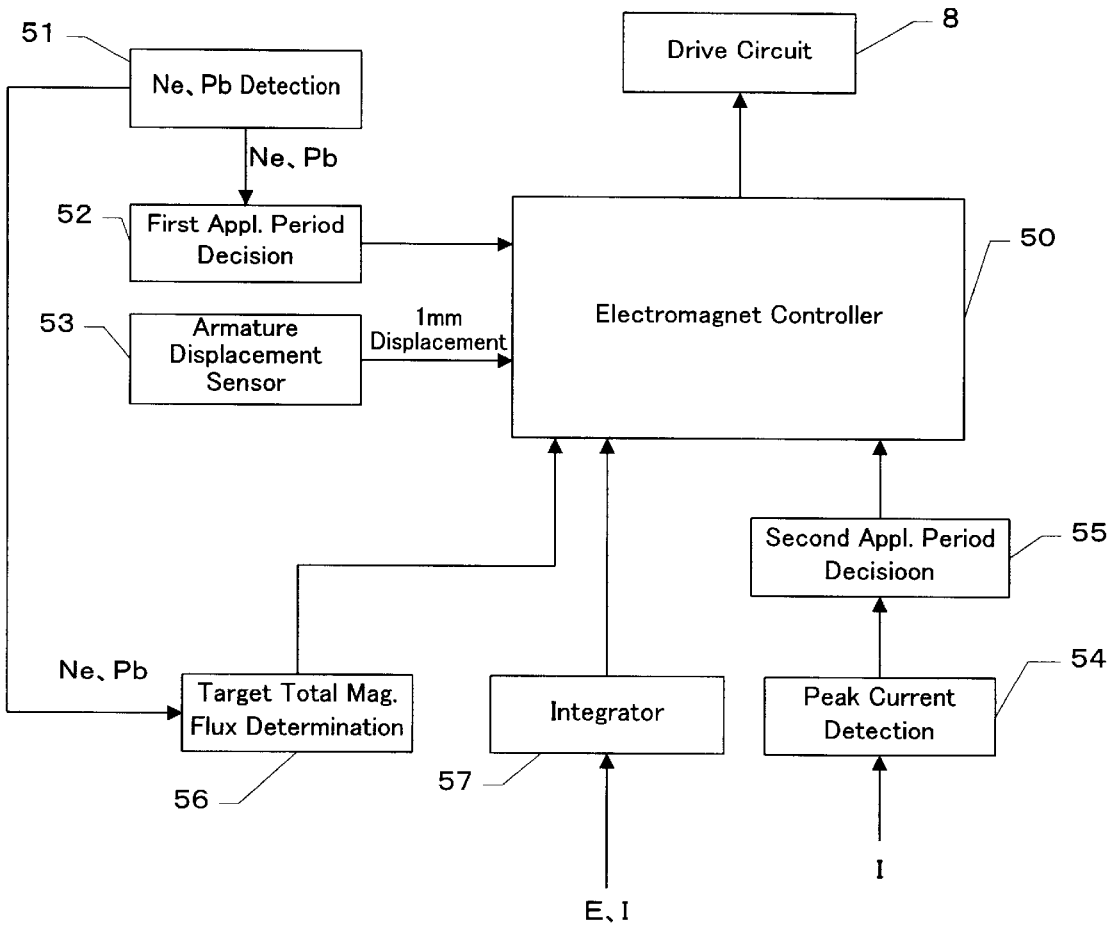
FIG. 9 is a functional block diagram of the electromagnetic actuator controller according to the second and the third embodiments of the invention.

FIG. 9 is a functional block diagram of the second embodiment. The same reference numerals with FIG. 3 are used for corresponding blocks and description on such blocks is not repeated.

A target total magnetic flux determination unit 56 determines the total magnetic flux that is necessary for seating the armature, based on current Ne and Pb detected by the Ne, Pb detector 51. This determination is made referring to a map indicating the correspondence among Ne, Pb and the target total magnetic flux. This map is stored in ROM.

When voltage application to the windings is started, integrator 57 starts integral calculation of the total magnetic flux in accordance with the expression (2), based on the voltage applied to the windings and the current through the windings.

Electromagnet controller 50 compares target magnetic flux given by target total magnetic flux determination unit 56 and value of current estimated total magnetic flux given by integrator 57, and calculates the difference between the current estimated total magnetic flux and the target total magnetic flux. Electromagnet controller 50 controls power supply to the windings such that the magnetic flux difference converges to zero.

Figure 10:
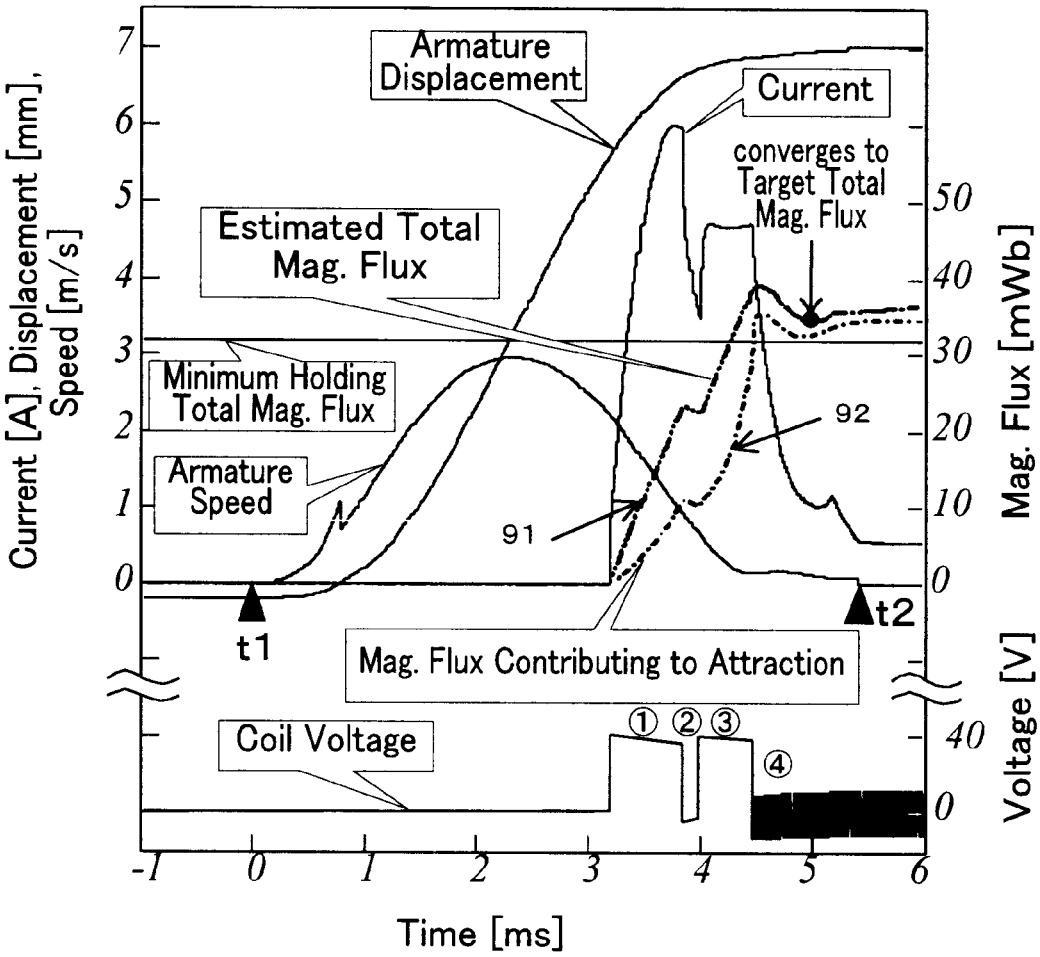
FIG. 10 shows the relationship among various parameters when flux control is performed after the first through the third over-excitation is performed according to the second embodiment of the invention.

Referring to FIG. 10, the scheme according to the second embodiment of the invention will be described. Magnetic flux is controlled after over-excitation to windings is performed. When application of voltage of 42V starts at time 3.2 ms, because this voltage is almost constant, the estimated total magnetic flux calculated by expression (2) increases linearly as shown by curve 91. Magnetic flux which links with the armature is very small and leakage flux is large in the early stage when the armature starts to move, Thus, magnetic flux making linkage with the armature becomes as indicated by line 92. Total magnetic flux shown by the curve 92 is the magnetic flux contributing to attraction power. The leak magnetic flux makes linkage in a leak space.

As the armature comes closer to the seating position, leak magnetic flux makes linkage with the armature, resulting in rapid growth of the magnetic flux linkage. When the armature seats on the yoke of the electromagnet, the magnetic flux weakens by power control, which is to be described hereafter. The difference between the maximum of curve 91 and the maximum of curve 92 is attributed to the resistance R of expression (2) that is set to a value larger than DC resistance, and to increase of leak flux that takes place as the flux in the yoke saturates.

In an actual operation, the correlation between the magnetic attraction power and the estimated total magnetic flux provided by expression (2) can be determined and the controller can be designed accordingly. Thus, the difference does not raise a problem. For example, the final estimate of magnetic flux can be made to agree to a real value by setting the value of R to about 1.8 times of the DC resistance. As R may vary with operating temperature, it is desirable that curve 91 be modified in consideration of the operating temperature.

At the same time the three period over-excitation finishes, feedback control is started to make the estimated total magnetic flux provided by sequential computation in accordance with expression (2) converge into the target total magnetic flux that is preset based on engine speed Ne and intake pipe pressure Pb (in this example, it is magnetic flux corresponding to period shown by a black dot on curve 91, and it is 34 mWb). Specifically, in the fourth application periods (shown by ④, voltage 12 V is applied to the windings with switching control, that is 12 V is switched on and off repeatedly. By making the estimated total magnetic flux calculated by expression (2) converge to the target total magnetic flux, magnetic flux contributing to attraction power can converge into the minimum holding magnetic flux that is necessary for holding the armature. In the example shown in the drawing, the estimated total magnetic flux converges into the target total magnetic flux at about 5.0 ms.

In the example of FIG. 10, after the 5.0 ms point in time, flux control is done such that the estimated total magnetic flux increases a little in order to give the magnetic flux contributing to the attraction force a little margin or a latitude as against the minimum holding magnetic flux. Thus, the attraction force at the time of seating can be optimized and a stable seating state can be maintained thereafter.

Figure 11:
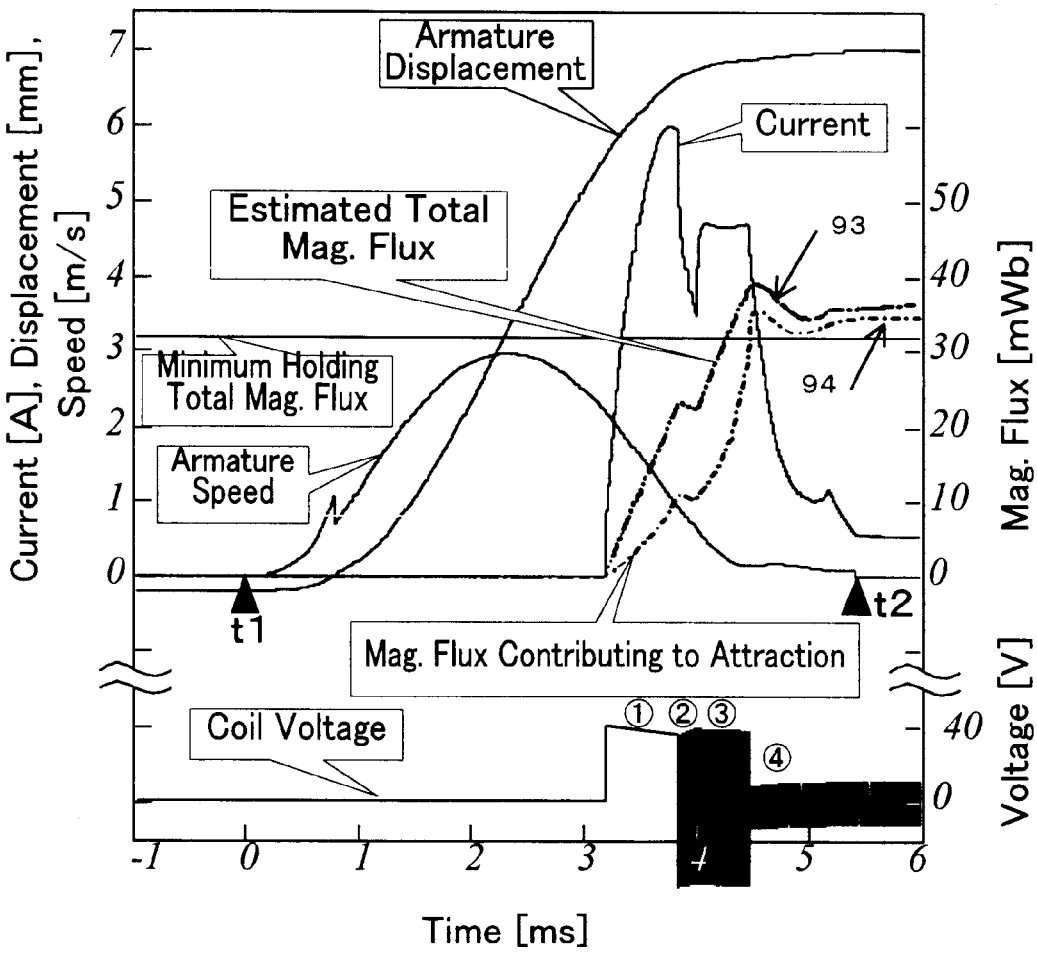
FIG. 11 shows the relationship among various parameters according to the third embodiment.

Referring to FIG. 11, a third embodiment of the invention will be described. After the first application period, the power supply to the windings is controlled to converge into the predetermined waveform of the target total magnetic flux in accordance with the peak current in the first application period. According to this embodiment, because current estimated total magnetic flux converges into a target total magnetic flux based on peak current in the first application period, the attraction power can be controlled responsive to variation of oscillation orientation of the armature in the first application period. Therefore, after the first application period elapses, the armature can make a stable seating, and a stable seated state can be maintained.

In FIG. 11, after the first application elapsed, in a period corresponding to previously described second and third application periods, 42 V is supplied to the windings by switching control such that total magnetic flux estimated by expression (2) rapidly converges into the target total flux. After the third application period, 12 V is supplied by switching control in the fourth application period (shown by ④ in order to maintain a stable seated state (switching control of 42 V may be continued after the third application period with less power). Thus, current estimated total magnetic flux converges to the target total magnetic flux.

Figure 12:
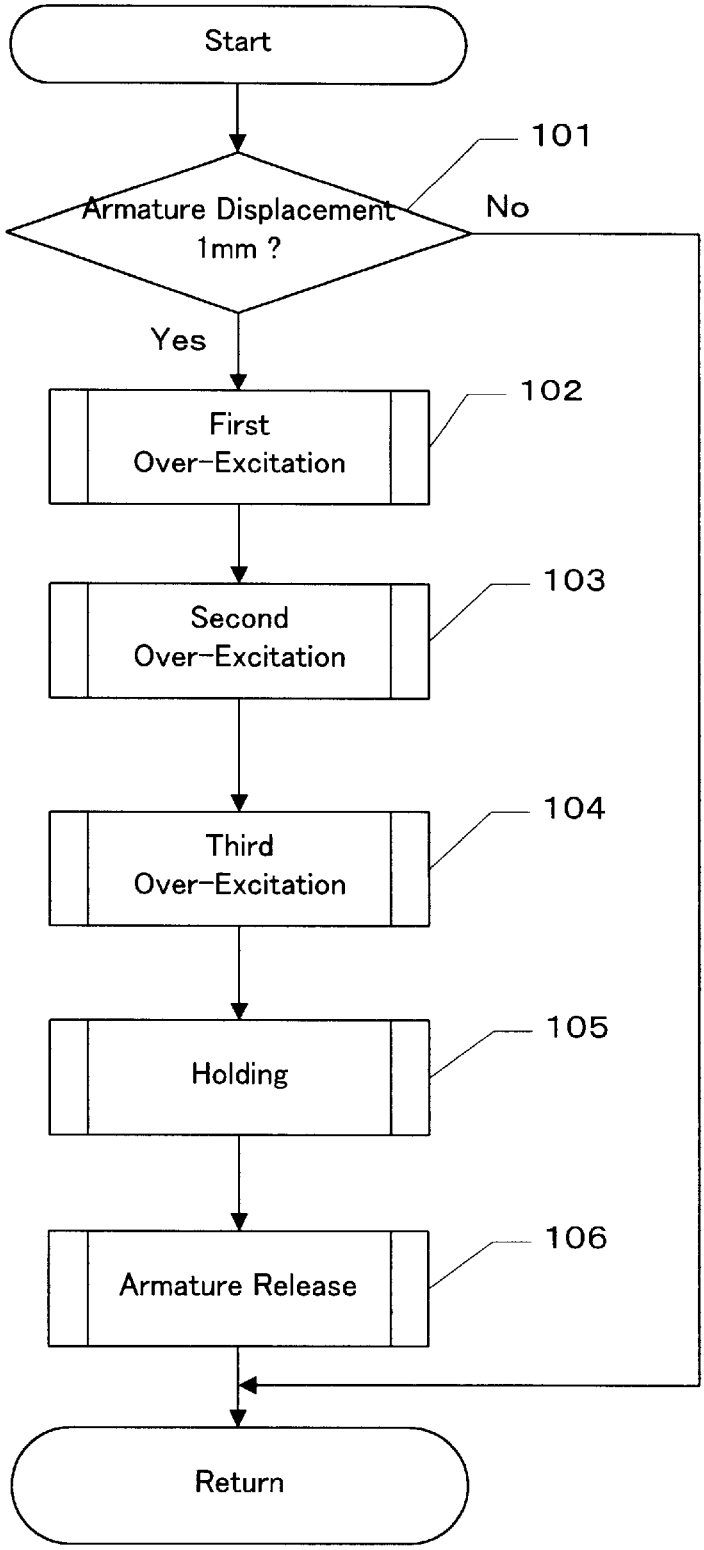
FIG. 12 is a flowchart showing general operation of the electromagnetic actuator control according to one embodiment of the invention.

FIG. 12 is a flowchart showing the process of actuating the electromagnetic actuator control in accordance with the first embodiment of the invention. The process is repeated at predetermined intervals. In step 101, judgment is made as to whether displacement of an armature has reached 1 mm. If it has not reached, the process exits the routine. If it has reached, value 1 is set to the first over-excitation permission flag, and the first over-excitation is carried out (102). The first over-excitation routine is followed by the second over-excitation routine (103), and the third over-excitation routine (104). After over-excitation for the three periods finishes, holding routine for holding the armature in a seated state is carried out (105). That is, switching control is carried out, for example, by switching ±12 V applied to the windings so that a current through the windings (coil) is held at the target holding current which is set based on current engine speed Ne and intake pipe pressure Pb. If release time of an armature set beforehand is reached, release operation of the armature is performed in step 106.

Figure 13:
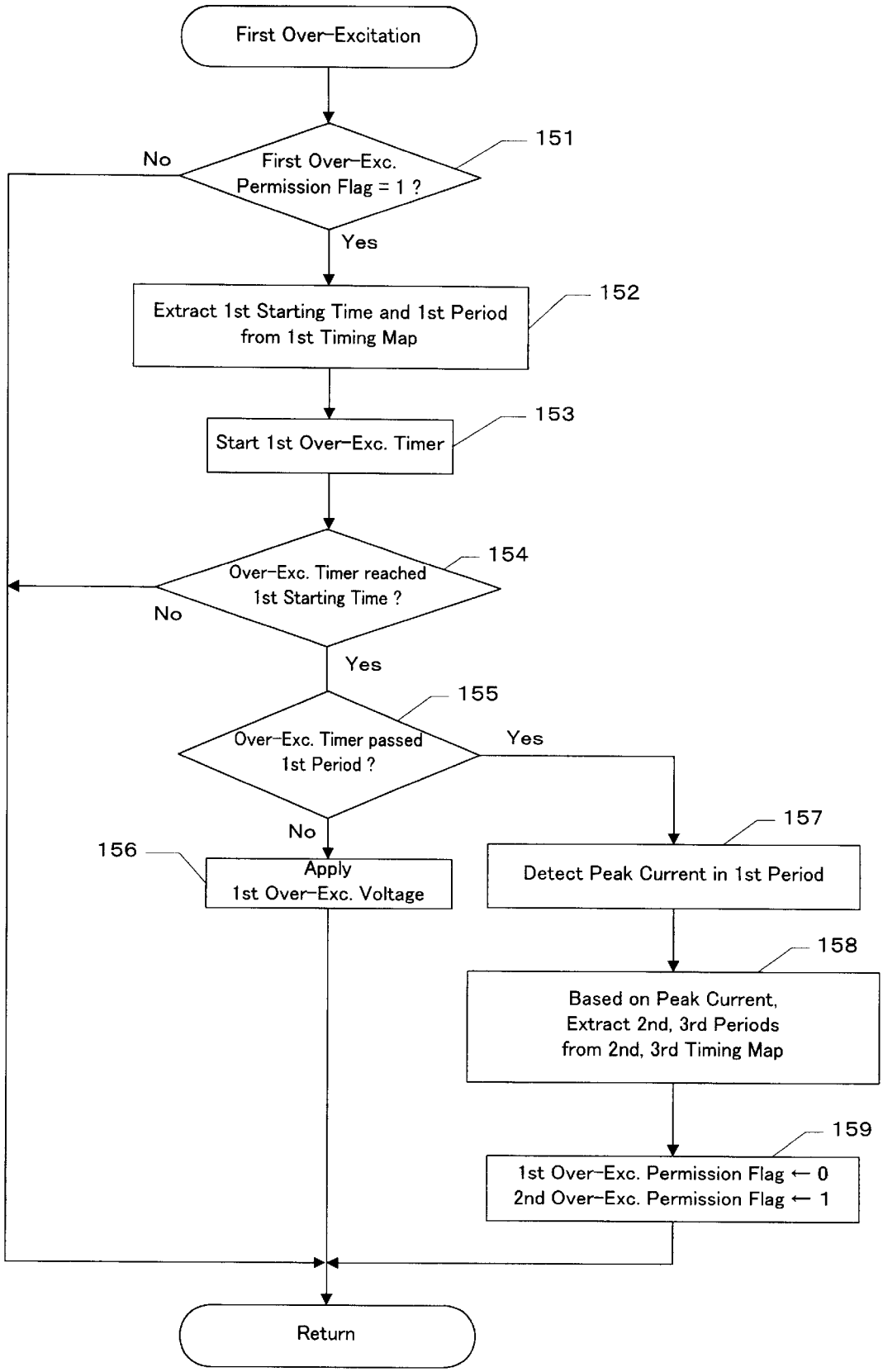
FIG. 13 is a flowchart showing the first over-excitation according to one embodiment of the invention.

FIG. 13 is a flowchart showing the first over-excitation performed in step 102 of FIG. 11. As shown in step 151, when value 1 is set to the first over-excitation permission flag, this routine starts. The first application starting time and the first application period are extracted from the first over-excitation timing map (152). The first over-excitation timing map is a map indicating correspondence among engine speed Ne, intake pipe pressure Pb, voltage application starting time and application period as described heretofore. Voltage application starting time is expressed as time from 1 mm displacement detection time.

In step 153, a first over-excitation timer (up timer) is activated, and starts to count up from zero. When the over-excitation timer reaches a first application starting time (154), if the first application period is yet to elapse (155), the first over-excitation voltage is applied to the windings (156).

If the first application period has elapsed (155), peak current in the first application period is detected (157). Based on the peak current value detected in step 157, the second and the third over-excitation timing map are referred to and the second and the third application periods are extracted (158). The second over-excitation timing map is a map indicating correspondence between the second application period and the peak current value in the first application period. The third over-excitation timing map is a map showing correspondence between the third application period and the peak current value in the first application period.

After the first application period, zero is set to the first over-excitation permission flag in step 159, value 1 is set to the second over-excitation permission flag in order to activate the second over-excitation routine.

Figure 14:
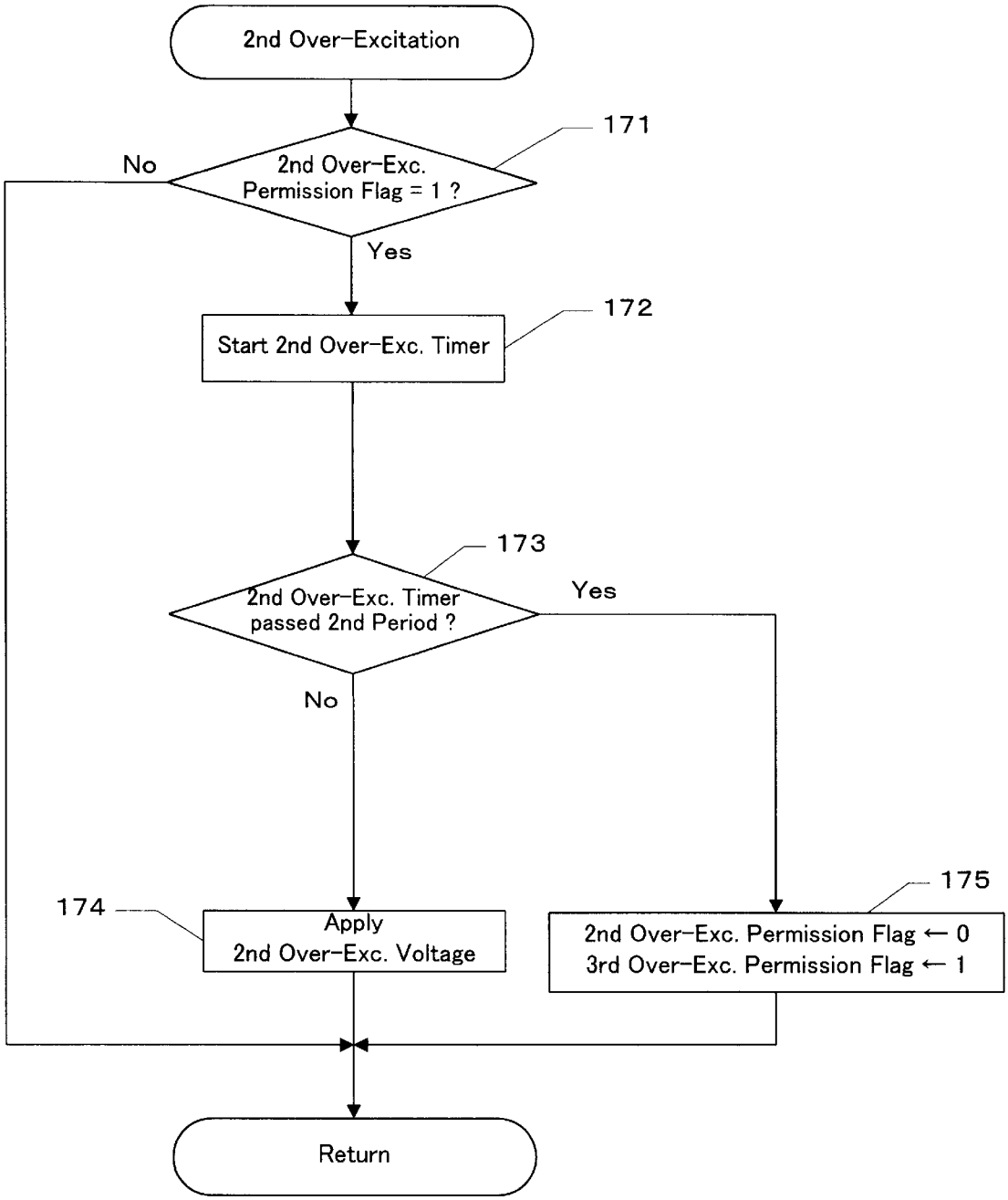
FIG. 14 is a flowchart showing the second over-excitation according to one embodiment of the invention.

FIG. 14 is a flowchart showing the second over-excitation performed in step 103 of FIG. 11. In step 171, the second over-excitation permission flag set in step 159 of FIG. 13 is checked to enter this routine. In step 172, the second application period extracted from the second over-excitation timing map in step 158 of FIG. 13 is set to a second over-excitation timer and the timer is started. This timer is a down timer which when started decrements the count.

In steps 173 and 174, till the second application period elapses, the second over-excitation voltage is applied to the windings. If the second application period passes, zero is set to the second over-excitation permission flag, and value 1 is set to the third over-excitation permission flag in order to activate the third next over-excitation routine (175).

Figure 15:
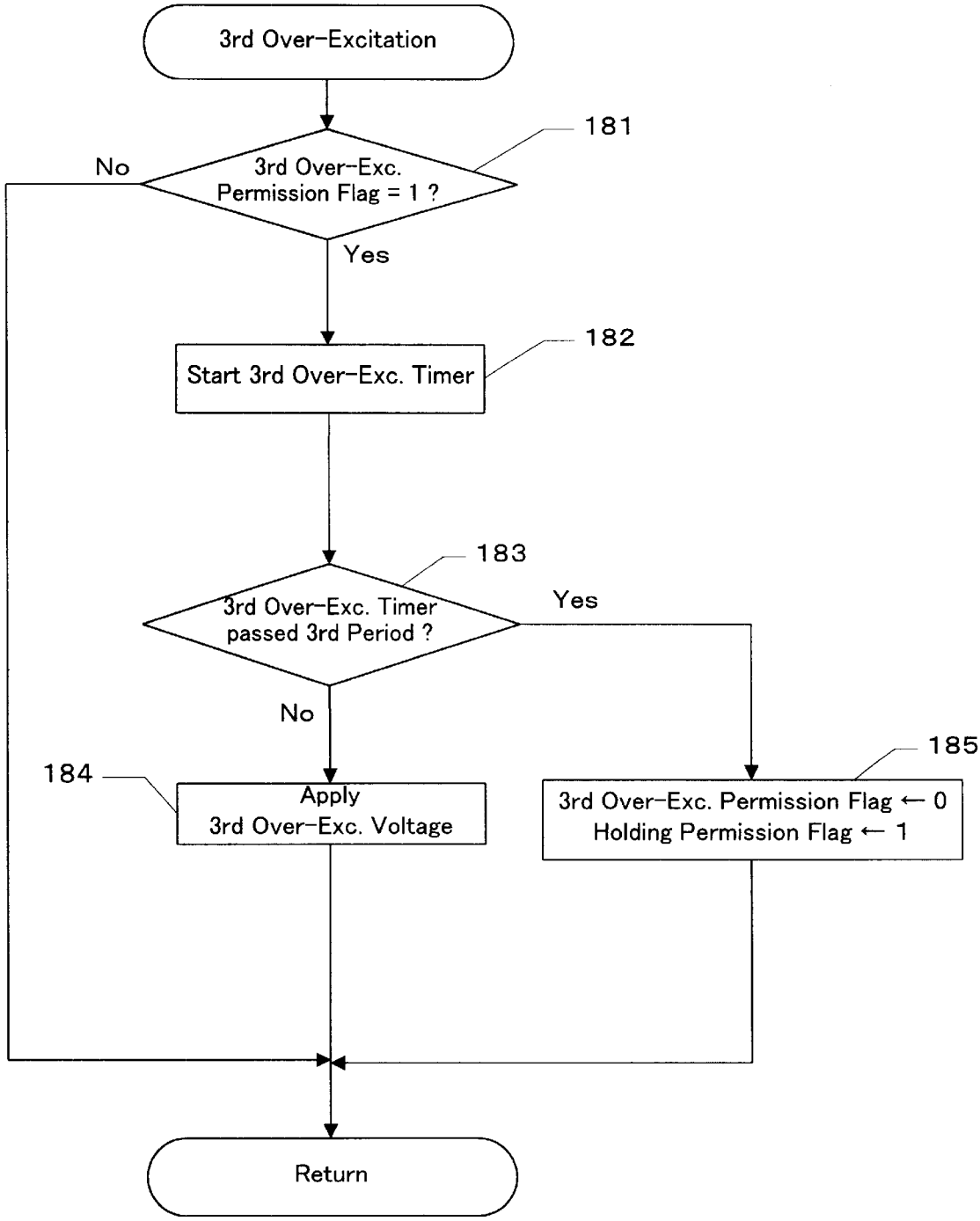
FIG. 15 is a flowchart showing the third over-excitation according to one embodiment of the invention.

FIG. 15 is a flowchart showing the third over-excitation performed in step 104 of FIG. 11. In step 181, the third over-excitation permission flag set in step 175 of FIG. 14 is checked to enter this routine. In step 182, the third application period extracted from the third over-excitation timing map in step 158 of FIG. 13 is set to a third over-excitation timer, and the timer is started. This timer is a down timer.

In steps 183 and 184, till the third application period passes, the third over-excitation voltage is applied to windings (184). If the third application period passes, step 185 is entered, and zero is set to the third over-excitation permission flag, and value 1 is set to the hold operation permission flag in order to activate hold operation routine.

Figure 16:
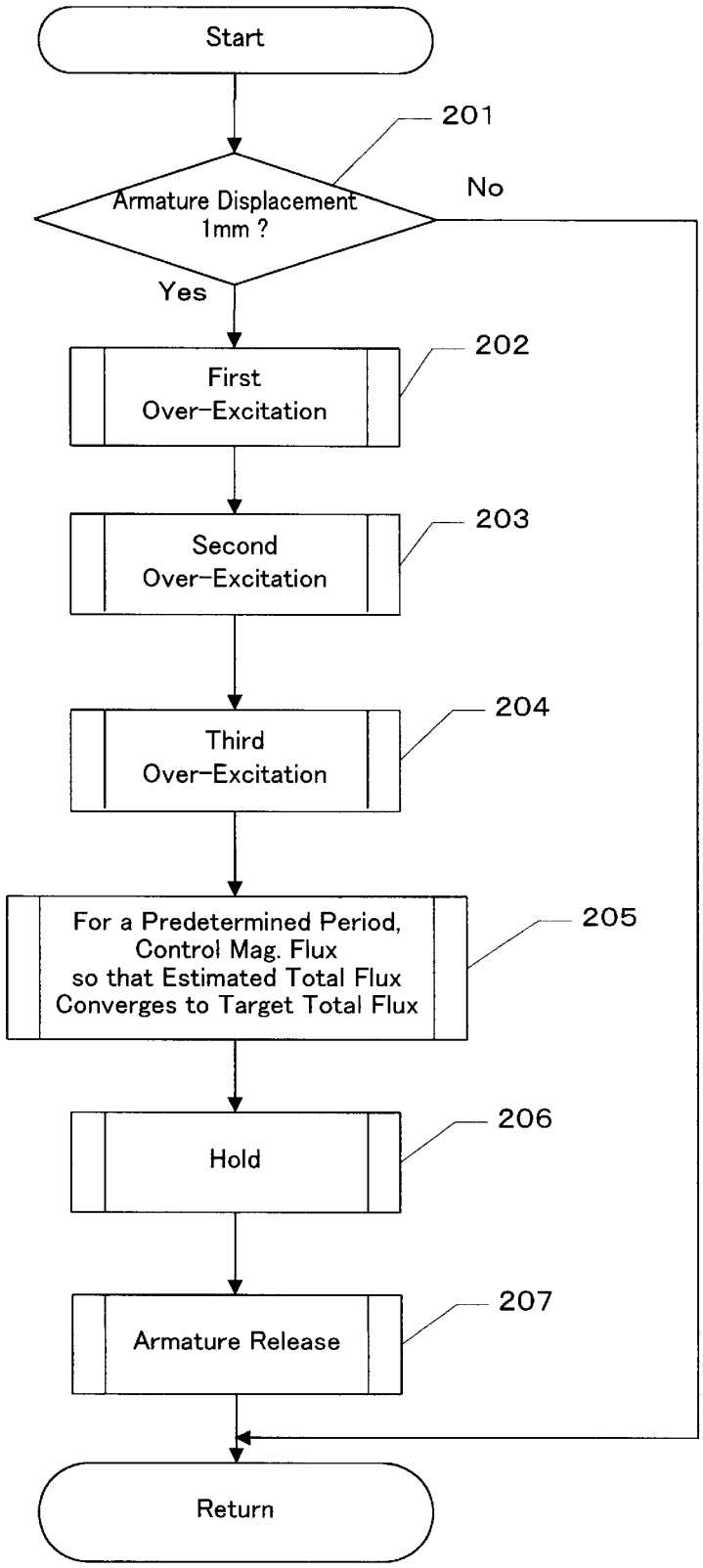
FIG. 16 is a flowchart showing general operation of electromagnetic actuator control according to the second embodiment of the invention.

FIG. 16 is a flowchart showing operation of the second embodiment in accordance with the invention. Between the over-excitation operation and the holding operation, flux control shown in step 205 is carried out, which is the difference from the first embodiment shown in FIG. 12. The over-excitation in steps 201 through 204, holding operation in step 206 and armature release operation in step 207 are the same as those of the first embodiment description.

After over-excitation divided into three periods finishes, and before the current is controlled to be the target holding current, in step 205, power supply to the windings is controlled for a predetermined period (for example, 1 ms) such that the estimated total magnetic flux converges to the target total magnetic flux. The target total magnetic flux is predetermined based on current engine speed Ne and intake pipe pressure Pb. The estimated total magnetic flux is calculated in accordance with expression (2) based on the current and voltage of the windings. Because variation of the estimated total magnetic flux can be thought as variation of the attracting force, by making the estimated total magnetic flux converge to the target total magnetic flux, the attraction power to the armature is optimized, and stable seated state can be realized. The predetermined period for the flux control in step 205 is predetermined. Alternatively, flux control may be continued till the estimated total magnetic flux converges to the target total magnetic flux.

Figure 17:
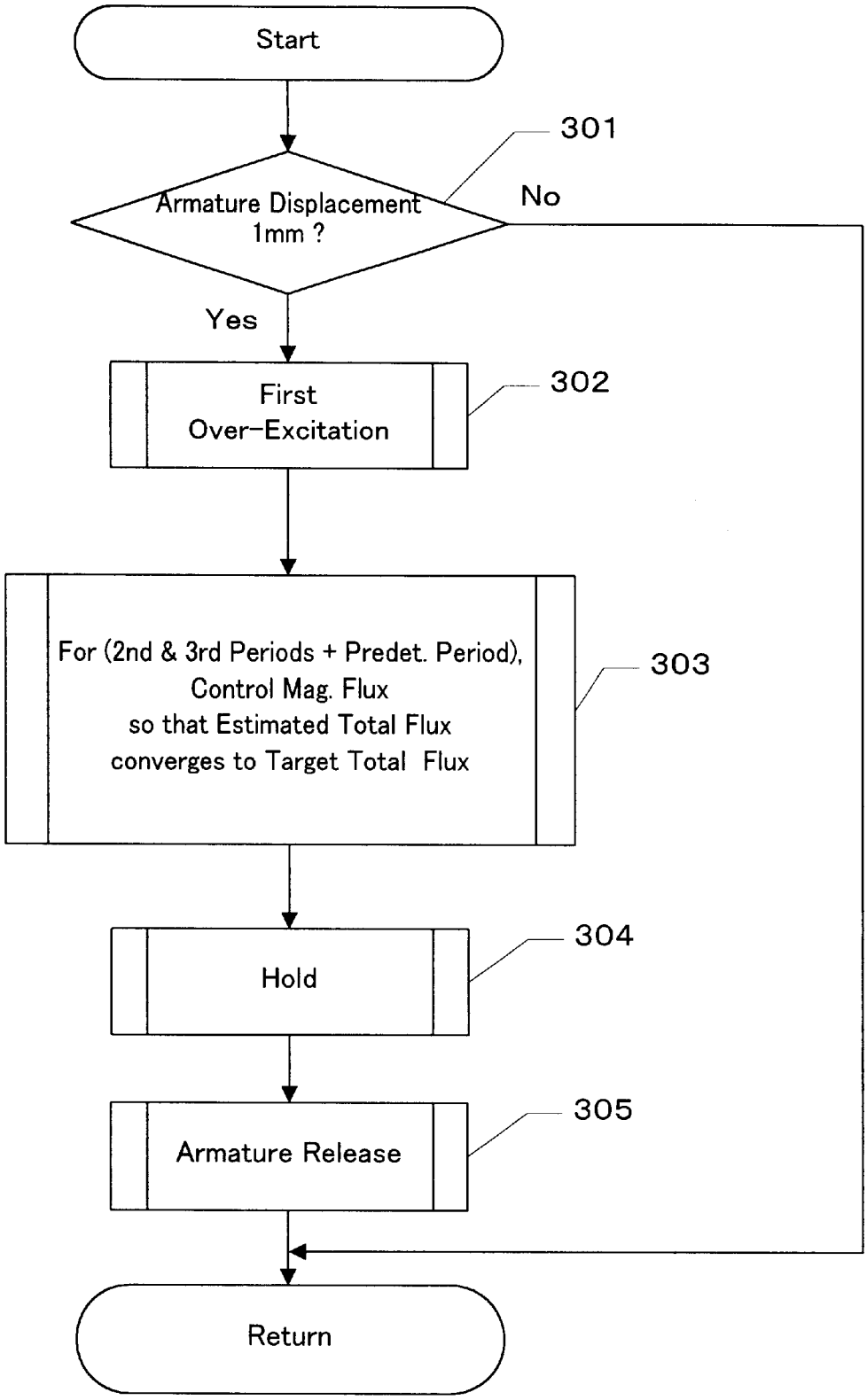
FIG. 17 is a flowchart showing general operation of electromagnetic actuator control according to the third embodiment of the invention.

FIG. 17 is a flowchart showing the operation of the third embodiment of the invention. Between the first over-excitation and the holding operation, flux control shown in step 303 is carried out, which is the difference from the first embodiment shown in FIG. 11. The first over-excitation in steps 301 and 302, holding operation in step 304 and armature release operation in step 305 are the same as those of the first embodiment.

After the first over-excitation and before the current is controlled to the target holding current, for a period corresponding to [the second application period+the third application period+a predetermined period], power supply to the windings is controlled such that the estimated total magnetic flux converges into the time waveform of the target total magnetic flux that is predetermined based on current peak value in the first application period. The predetermined period here is 1 ms, as an example. The estimated total magnetic flux is calculated in accordance with expression (2) based on present current and voltage of the windings As with the case of the second embodiment, variation of the estimated total magnetic flux can be regarded as variation of the attraction power. The attraction power to the armature is optimized by making the estimated total flux converge to the target total magnetic flux. Thus, a stable seating of the armature can be realized. The predetermined period in step 303 is predetermined. Alternatively, flux control may be continued till the estimated total magnetic flux converges into the target total magnetic flux.

As described with reference to specific embodiments, the armature can make a stable seating by detecting peak current in the first application period and controlling over-excitation thereafter based on the peak current. Specific values described with respect to the embodiments are merely examples. The scope of the invention is not limited to the embodiments or the specific values. For example, the applied voltages such as 42 V and the voltage in the switching control (±12 V) are merely examples. Different voltages may be used. For example, holding operation can be performed with a 42 V power source.

What is claimed is:

1. A controller for an electromagnetic actuator having a pair of springs acting on opposite directions, an armature coupled to a mechanical element, said armature connected to the springs to be held in a neutral position given by the springs when the armature is not activated, and a pair of electromagnets for driving the armature between two end positions, the controller comprising:

voltage application means for applying voltage during a first predetermined period to an electromagnet corresponding to one of the end positions so that the armature is attracted to said one of the end positions;

a peak current detector for detecting peak current flowing in the electromagnet in the first predetermined period; and voltage application decision means for deciding a period of applying voltage to the electromagnet after the first application period, in accordance with the peak current detected by the peak current detector.

2. The controller according to claim 1, wherein the voltage application decision means decides a voltage to be applied to the electromagnet after the first application period, in accordance with the peak current detected by the peak current detector.

3. The controller according to claim 1, wherein the voltage application decision means decides a second application period of a second voltage and a third application period of a third voltage, in accordance with the peak current detected by the peak current detector; and said voltage application means applies the second voltage to the electromagnet during the second application period after the first application period, and applies the third voltage to the electromagnet during the third application period after the second application period, the second voltage being lower than the first voltage and the third voltage being higher than the second voltage.

4. The controller according to claim 1, further comprising:

estimation means for estimating magnetic flux that is generated by the electromagnet attracting the armature when the armature is driven from one end position to the other end position; and a power controller controlling power supply to the electromagnet such that the magnetic flux estimated by the estimation means converges into the magnetic flux that is necessary to hold the armature in the other end position, after voltage application to the electromagnet for the application period decided by the voltage application decision means has finished.

5. The controller according to claim 1, further comprising:

estimation means for estimating the magnetic flux that the electromagnet attracting the armature generates when the armature is driven from one end position to the other end position; and a power controller controlling power supply to the electromagnet such that the magnetic flux estimated by the estimation means converges into the magnetic flux that is determined based on the peak current detected by the peak current detector, after voltage application to the electromagnet for the first application period has finished.

6. A storage medium holding instructions executable by a computer for performing a method of controlling an electromagnetic actuator having a pair of springs acting in opposite directions, an armature coupled to a mechanical element, said armature connected to the springs and adapted to be held in a neutral position given by the springs when the armature is not activated, and a pair of electromagnets for driving the armature between two end positions, the method comprising the steps of:

applying voltage during a first predetermined period to an electromagnet corresponding to one of the end positions so that the armature is attracted to said one of the end positions; and deciding a period of applying voltage to the electromagnet after the first period, in accordance with the peak current detected by a peak current detector for detecting peak current flowing in the electromagnet in the first period.

7. The storage medium of claim 6, wherein the voltage to be applied to the electromagnet is decided after the first period, in accordance with the peak current detected by the peak current detector.

8. The storage medium of claim 6, the method further comprising the steps of:

deciding a second period of a second voltage and a third period of a third voltage, in accordance with the peak current detected by the peak current detector; and applying the second voltage to the electromagnet during the second period after the first period, and apply the third voltage to the electromagnet during the third period after the second period, the second voltage being lower than the first voltage and the third voltage being higher than the second voltage.

9. The storage medium of claim 6, the method further comprising the steps of:

estimating magnetic flux that is generated by the electromagnet attracting the armature when the armature is driven from one end position to the other end position; and controlling power supply to the electromagnet such that the estimated magnetic flux converges into the magnetic flux that is necessary to hold the armature in the other end position, after voltage application to the electromagnet for the application period has finished.

10. The storage medium of claim 6, the method further comprising the steps of:

estimating the magnetic flux that the electromagnet attracting the armature generates when the armature is driven from one end position to the other end position; and controlling power supply to the electromagnet such that the estimated magnetic flux converges into the magnetic flux that is determined based on the peak current, after voltage application to the electromagnet for the first period has finished.

11. A method for controlling an electromagnetic actuator having a pair of springs acting on opposite directions, an armature coupled to a mechanical element, said armature connected to the springs to be held in a neutral position given by the springs when the armature is not activated, and a pair of electromagnets for driving the armature between two end positions, comprising:

applying voltage during a first predetermined period to an electromagnet corresponding to one of the end positions so that the armature is attracted to said one of the end positions;

detecting peak current flowing in the electromagnet in the first period; and deciding a period of applying voltage to the electromagnet after the first period, in accordance with the peak current detected by the peak current detector.

12. The method according to claim 11, wherein voltage to be applied to the electromagnet is decided after the first application period, in accordance with the peak current detected by the peak current detector.

13. The controller according to claim 11, wherein a second application period of a second voltage and a third application period of a third voltage are decided in accordance with the peak current; and the second voltage to the electromagnet is applied during the second application period after the first period, and the third voltage to the electromagnet is applied during the third application period after the second application period, the second voltage being lower than the first voltage and the third voltage being higher than the second voltage.

14. The method according to claim 11, further comprising:

estimating magnetic flux that is generated by the electromagnet attracting the armature when the armature is driven from one end position to the other end position; and controlling power supply to the electromagnet such that the estimated magnetic flux estimated converges into the magnetic flux that is necessary to hold the armature in the other end position, after voltage application to the electromagnet for the application period has finished.

15. The method according to claim 11, further comprising:

estimating the magnetic flux that the electromagnet attracting the armature generates when the armature is driven from one end position to the other end position; and controlling power supply to the electromagnet such that the estimated magnetic flux converges into the magnetic flux that is determined based on the peak current after voltage application to the electromagnet for the first period has finished.

* * * * *